United States Patent [19]

Murphy

[11] Patent Number: 4,570,802

[45] Date of Patent: Feb. 18, 1986

[54] PRINTER STAND

[76] Inventor: Michael E. Murphy, R. 6, Phillip Geyer Rd., Boonville, Ind. 47601

[21] Appl. No.: 586,396

[22] Filed: Mar. 5, 1984

[51] Int. Cl.[4] ..... A47F 7/00

[52] U.S. Cl. ..... 211/13; 211/50; 248/176; 248/441.1

[58] Field of Search ..... 211/13.50, 42; D6/155, D6/184, 180, 85, 181; 248/127, 676, 152, 176, 442.2, 174, 441.1, 460; 312/183

[56] References Cited

U.S. PATENT DOCUMENTS

| | | | |
|---|---|---|---|
| 1,717,456 | 6/1929 | Lasher | 248/174 |
| 1,802,060 | 4/1931 | Neely | 211/50 X |
| 2,266,966 | 12/1941 | Fairchild | 248/174 |
| 2,920,244 | 1/1960 | Miksit et al. | 248/127 X |
| 2,940,710 | 6/1960 | Adams | 248/174 |
| 4,313,112 | 1/1982 | Foster | 248/442.2 X |

FOREIGN PATENT DOCUMENTS

| | | | |
|---|---|---|---|
| 463785 | 8/1928 | Fed. Rep. of Germany | 248/441.1 |

*Primary Examiner*—Robert W. Gibson, Jr.
*Attorney, Agent, or Firm*—Warren D. Flackbert

[57] ABSTRACT

A stand for a printer typically included with a computer installation characterized by side support walls which serve to position the printer at an inclined angle, where such reduces space requirements on the supporting surface and, at the same time, affords more effective viewing capabilities, both in contrast to the instance where the printer lies in a horizontal plane. Additionally, paper storage space is provided within the stand and a carrying provision affords ease in portability.

2 Claims, 4 Drawing Figures

PRINTER STAND

As is known, computer usage, for a variety of end purposes, is quite widespread, where an independent printer unit is typically involved with each installation. In most instances, however, the printer is placed on a working surface proximate the computer layout, as on the same table or, perhaps, an adjacent table. In other words, and as known, once the computer problem has been finalized, the printer is required for recording and/or presenting the results. In most arrangements, not only does the printer lie directly, i.e. horizontally, on the working surface, but the paper supply for the printer also consumes additional storage space.

The invention presents a printer stand which provides multi-advantages to the user, to-wit, the printer is in an angled position on the stand, requiring lesser work space usage; a paper storage area is provided beneath the printer and within the stand, again minimizing needed storage or working space; and, also importantly, the placement of the printer in an angled relationship affords ready viewing of the material during paper feed-out from the printer, i.e. even when the viewer is at a sitting position.

In other words, and as to the latter, when the printer is at a horizontal position of use, the viewer is reading the printed material either at an awkward angle from a sitting position or must be standing, both of which disadvantages are overcome by the stand presented herein.

Briefly, the printer stand of the invention is defined by side walls each including a downwardly and forwardly angling edge and a bottom angled receiving edge adapted or customized to accommodate a commercially available printer, where each of the side walls may include cut out areas for ease in stand transporting. The side walls are assembled through connecting walls which, at the same time, serve paper storage purposes.

Additionally, the paper print-out, if not immediately separated, may accumulate in an area partially within the stand and partially on the supporting and/or working surface adjacent the stand. The inclined portions of the side edge walls may assume various angles with respect to the horizontal, where, for example, 45° and 60° have proven satisfactory, not only to reduce overall plan base area, but, as well, for the aforesaid ease in viewing the printed readout material.

The stand represents a minimum of assembled components and may be made from wood or other lightweight material, where a better understanding of the present invention will become more apparent from the following description, taken in conjunction with the accompanying drawing, wherein FIG. 1 is a view in front elevation showing a printer stand in accordance with the teachings of the present invention, with a typical printer fragmentarily illustrated in an operative position thereon;

Figures 1, 2, 3, 4:
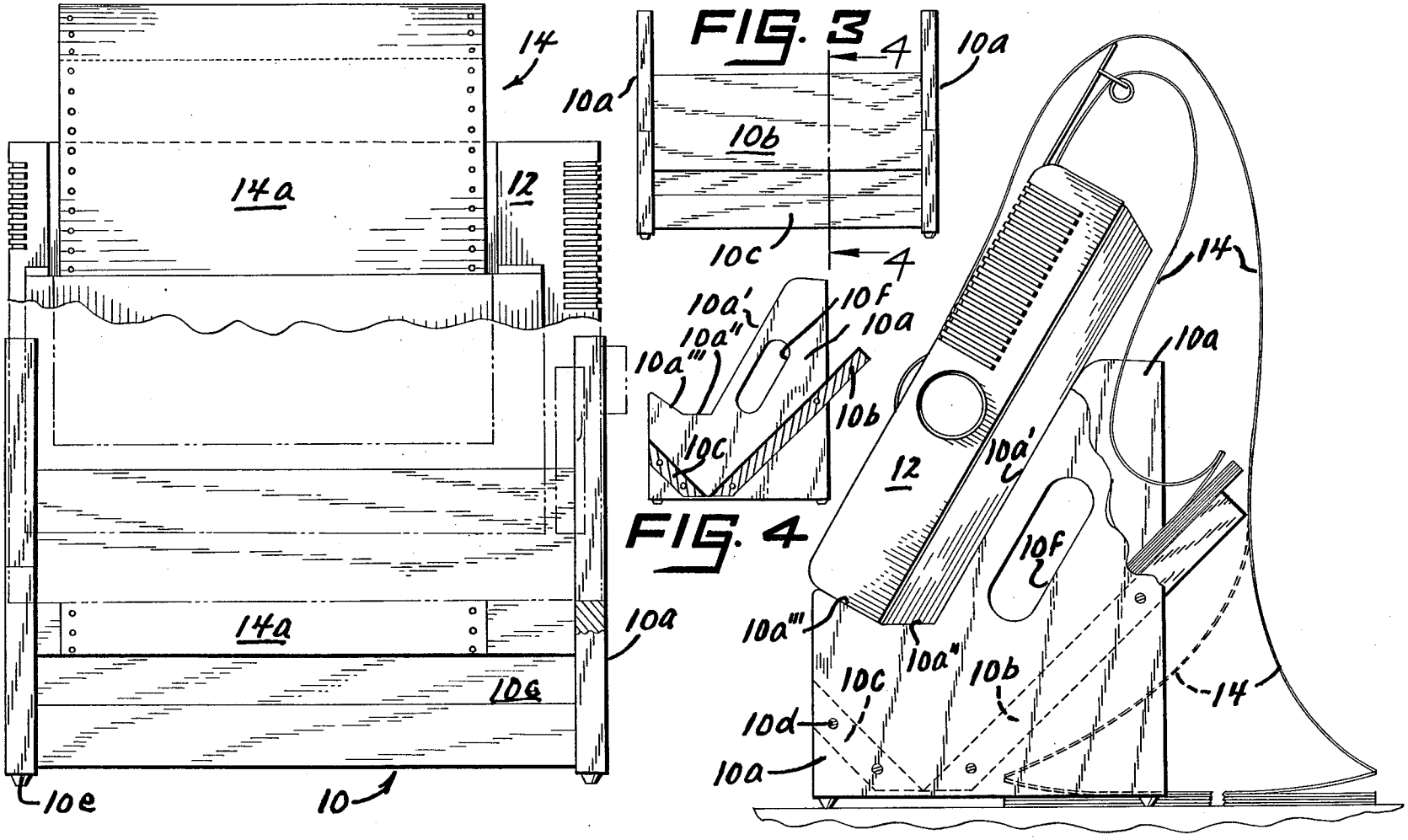
FIG. 2 is a view in side elevation, corresponding to FIG. 1, and looking from right to left in such figure.
FIG. 3 is another view in front elevation, in smaller scale than FIG. 1, showing the instant printer prior to use; and, FIG. 4 is a view in side elevation, taken at line 4—4 on FIG. 3 and looking in the direction of the arrows, further detailing the printer of the invention.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the figures, printer stand 10 of the invention is shown in combination with a conventional commercially available printer 12, where, as known, the printer 12 receives paper and subsequently feeds such in printed form in accordance with the commands and/or instructions of an associated computer (not shown).

In any event, the instant printer stand 10 is defined by side walls **10*a* connected together by a rear forwardly and downwardly angling wall or member 10*b* and a front upwardly and forwardly angling wall or member 10*c*. In the instance of the use of wood, assembly is completed by threaded means, as screws 10*d* or the like. Typically, the overall unit may further include feet 10*e***.

Importantly, each of the side walls **10*a* is cut out to present a forwardly and downwardly extending edge 10*a*', communicating with a horizontal portion 10*a*'' which, in turn, communicates with a forwardly and upwardly extending portion 10*a*'''. The exact arrangement of the portions 10*a*', 10*a*'' and 10*a*''', i.e. the configuration thereof, is dependent, largely, upon the dimensioning of the printer 12 with which the stand 10 is utilized. In other words, the edge portions 10*a*', 10*a*'' and 10*a*''' of each wall 10*a*** can be modified and/or customized to receive any particular printer unit.

The angling of the printer primarily conserves working area, i.e. in contrast to a printer lying in a horizontal position, but additionally, and also importantly, the forwardly and downwardly extending edge portions **10*a*' determine the viewing angle of the printed material feeding through the printer 12**. As stated, such typically assumes an angle, from horizontal, of 45° or 60°, or, perhaps, an approximate range including such preferred angles.

Restated otherwise, the aforesaid angle serves to present the printer 12 in an easily readable position, in contrast to where the printer formerly lay horizontally on a surface, and, as well, to reduce the surface area required for printer 12 usage. Further, and to expedite transporting, gripping areas **10*f* are provided on each side wall 10*a***, where such may assume any desired configuration, if cut out, or may even be in the form of handles.

Moreover, the printer stand 10 affords an effective storage space for printer paper 14, typically available in foldable sections **14*a*. In other words, and as particularly apparent in FIG. 2, the paper 14 supply is stored on the wall or member 10*b*, abutted, in a blocking relationship, by the wall or member 10*c*. As needed, the paper 14 is fed into the printer 12, processed, and then either torn (at perforated section lines) or permitted to accumulate in the space below the wall or member 10*b* on the supporting surface, i.e. and typically, partially beneath the stand 10** and partially on the adjacent surface.

The preceding should adequately demonstrate the advantages and/or added capabilities of the stand of the invention, where, again, a reduction in overall surface area requirements is paramount, coupled with the convenience of printer readout viewing while even at a sitting position. Additionally, with the paper storage feature, it should be evident that the invention presents a self-contained arrangement affording both printer and storage convenience, viz. in viewing access, portability and in connection with the paper supply.

The printer stand described above is susceptible to various changes within the spirit of the invention, including, for example, in proportioning, the type of material employed, the capacity of the paper storage space, and, the like. Thus, the preceding should be considered illustrative and not as limiting the scope of the following claims:

I claim:

1. A printer stand comprising side walls and a first forwardly inclined wall interconnecting said side walls, each of said side walls characterized by a rearwardly inclined edge portion against which a printer is angularly disposed, said rearwardly inclined edge portion blending into a lower forwardly inclined edge portion serving a printer support relationship, and where a second rearwardly inclined wall interconnecting said side walls abuts with said first forwardly inclined wall behind said printer to present an unprinted paper storage area for said printer.

2. The printer stand of claim 1 where an area in the space beneath said second rearwardly inclined wall selectively serves for storage of printed paper.

* * * * *